US007925179B2

(12) United States Patent
Itabashi

(10) Patent No.: US 7,925,179 B2
(45) Date of Patent: Apr. 12, 2011

(54) IMAGE FORMING APPARATUS WITH DUST-PROOF WALL

(75) Inventor: Nao Itabashi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 67 days.

(21) Appl. No.: 12/201,551

(22) Filed: Aug. 29, 2008

(65) Prior Publication Data

US 2009/0060562 A1 Mar. 5, 2009

(30) Foreign Application Priority Data

Aug. 31, 2007 (JP) ..... 2007-225936

(51) Int. Cl.
*G03G 21/00* (2006.01)
*G03G 13/04* (2006.01)
*B41J 2/385* (2006.01)

(52) U.S. Cl. ..... 399/98; 347/129; 347/138

(58) Field of Classification Search ..... 399/98, 399/177; 347/129, 138
See application file for complete search history.

(56) References Cited

U.S. PATENT DOCUMENTS 4,703,334 A * 10/1987 Mochimaru et al. ..... 347/138 X
4,905,028 A * 2/1990 Okubo et al. ..... 347/138
5,752,137 A 5/1998 Haneda
7,684,725 B2 * 3/2010 Suyama et al. ..... 399/98

FOREIGN PATENT DOCUMENTS

| | | |
|---|---|---|
| JP | 01-125452 | 8/1989 |
| JP | 02-040541 | 3/1990 |
| JP | 05-286172 | 11/1993 |
| JP | 08-334973 | 12/1996 |
| JP | 2000-335008 | 12/2000 |
| JP | 2004-045795 | 2/2004 |
| JP | 2005-266278 | 9/2005 |
| JP | 2006-250970 | 9/2006 |

OTHER PUBLICATIONS

Office Action receiveed for Chinese Application No. 200810212718.1 mailed on Nov. 1, 2010.

* cited by examiner

*Primary Examiner* — Sandra L Brase
(74) *Attorney, Agent, or Firm* — Banner & Witcoff, Ltd.

(57) ABSTRACT

An image forming apparatus is provided. The image forming apparatus includes a photosensitive member; and an exposure member having a light emitting element, the exposure member exposing the photosensitive member at an exposure position opposed to an opposed position on the photosensitive member to form the electrostatic latent image, the exposure member being movable between the exposure position and a retreated position retreating from the exposure position, wherein the exposure member includes a dust-proof wall protruding more than a light-emitting surface of the exposure member and a positioning member positioning the exposure member with respect to the photosensitive member at the exposure position, and wherein the dust-proof wall and the positioning member are integrally formed.

13 Claims, 5 Drawing Sheets

IMAGE FORMING APPARATUS WITH DUST-PROOF WALL

CROSS REFERENCE TO RELATED APPLICATION

The present application claims priority from Japanese Patent Application No. 2007-225936, which was filed on Aug. 31, 2007, the disclosure of which is herein incorporated by reference in its entirety.

TECHNICAL FIELD

Apparatuses and devices consistent with the present invention relate to image forming apparatuses and more particularly, to image forming apparatuses in which a photosensitive member and a light emitting surface of an exposure member is disposed close to each other.

BACKGROUND

Japanese unexamined utility model application publication No. H02-40541 (See FIG. 2, Patent Document 1) and Japanese unexamined patent application publication No. 2004-45795 (See FIG. 6, Patent Document 2) describe related art image forming apparatuses. For example, the related art image forming apparatuses include a photosensitive member and a light-emitting surface of an exposure member (such as an LED head), and the photosensitive member and the light-emitting surface are disposed close to each other to expose the photosensitive member. In the related art image forming apparatuses, since the photosensitive member and the light-emitting surface of the exposure member are disposed close to each other, a developer floating from a developing unit supplying the developer to the photosensitive member is attached to the light-emitting surface to contaminate the light-emitting surface, thereby deteriorating the quality of image. Therefore, for example, Patent Document 1 or Patent Document 2 discloses a configuration in which a dust-proof wall or a shielding portion protruding toward the photosensitive member is disposed in the vicinity of the end (light-emitting surface) of the exposure member to prevent the developer floating from the developing unit from being attached to the light-emitting surface.

SUMMARY

However, since the above-mentioned related apparatus has a configuration in which the position of the dust-proof wall relative to the photosensitive member is indirectly determined by a positioning mechanism of the exposure member, the positioning precision of the dust-proof wall relative to the photosensitive member is not sufficient. Accordingly, the dust-proof wall does not get sufficiently close to the photosensitive member, thereby not satisfactorily preventing the developer floating from the developing unit from being attached to the light-emitting surface.

In order to make the dust-proof wall satisfactorily close to the photosensitive member by the use of the positioning mechanism of the exposure member, for example, when the size of the dust-proof wall is enhanced, the end of the dust-proof wall comes in contact with the photosensitive member due to the non-satisfactory positioning precision of the dust-proof wall relative to the photosensitive member, thereby damaging the surface.

An object of the present invention is to provide an image forming apparatus that can suppress the deterioration in quality of image by satisfactorily suppressing a developer floating from a developing unit from being attached to a light-emitting surface.

According to an aspect of the present invention, there is provided an image forming apparatus comprising: a photosensitive member in which an electrostatic latent image is formed on the surface thereof; and an exposure member having a light emitting element, the exposure member exposing the photosensitive member at an exposure position opposed to an opposed position on the photosensitive member to form the electrostatic latent image, the exposure member being movable between the exposure position and a retreated position retreating from the exposure position, wherein the exposure member includes a dust-proof wall protruding more than a light-emitting surface of the exposure member and a positioning member positioning the exposure member with respect to the photosensitive member at the exposure position, and wherein the dust-proof wall and the positioning member are integrally formed.

According to another aspect of the present invention, there is provided an image forming apparatus comprising: a photosensitive member; an exposure member having a light emitting element, a dust-proof wall protruding more than a light-emitting surface of the exposure member and a positioning member positioning the exposure member with respect to the photosensitive member at an exposure position; and a frame supporting the photosensitive member and having a through hole into which the dust-proof wall is inserted at the exposure position; wherein the dust-proof wall and the positioning member are integrally formed, wherein the dust-proof wall and the positioning member are disposed in a light-emitting surface side of the exposure member, and wherein when the exposure member is positioned at the exposure position, the positioning member contacts on the frame.

According to the image forming apparatus having the above-mentioned configuration, since the positioning member formed integrally with the dust-proof wall of the exposure member positions the exposure member relative to the photosensitive member, it is possible to position the dust-proof wall relative to the photosensitive member with high precision. Accordingly, it is possible to make the dust-proof wall satisfactorily close to the photosensitive member.

According to the image forming apparatus of the present invention, since the dust-proof wall can be positioned relative to the photosensitive member, it is possible to make the dust-proof wall satisfactorily close to the photosensitive member. Accordingly, since the attachment of the developer floating from the developing unit to the light-emitting surface can be sufficiently suppressed, it is possible to prevent the deterioration in quality of image.

BRIEF DESCRIPTION OF THE DRAWINGS

Illustrative aspects of the invention will be described in detail with reference to the following figures wherein:

FIGS. 4A and 4B are views showing the printer according to the exemplary embodiment in which FIG. 4A is a side view showing relations between the LED unit, the drum frame, and the photosensitive drum at an exposure position, and FIG. 4B is a sectional view thereof; and FIGS. 5A, 5B and 5C are views showing a printer according to another exemplary embodiment in which FIG. 5A is a partial sectional view showing an LED unit and a drum frame as viewed from a side, FIG. 5B is a partial sectional view of the LED unit and the drum frame as viewed from the rear side, and FIG. 5C is a plan view of the LED unit and the drum frame as viewed from the upside.

DETAILED DESCRIPTION OF THE PREFERRED EMBODIMENTS

Figure 1:
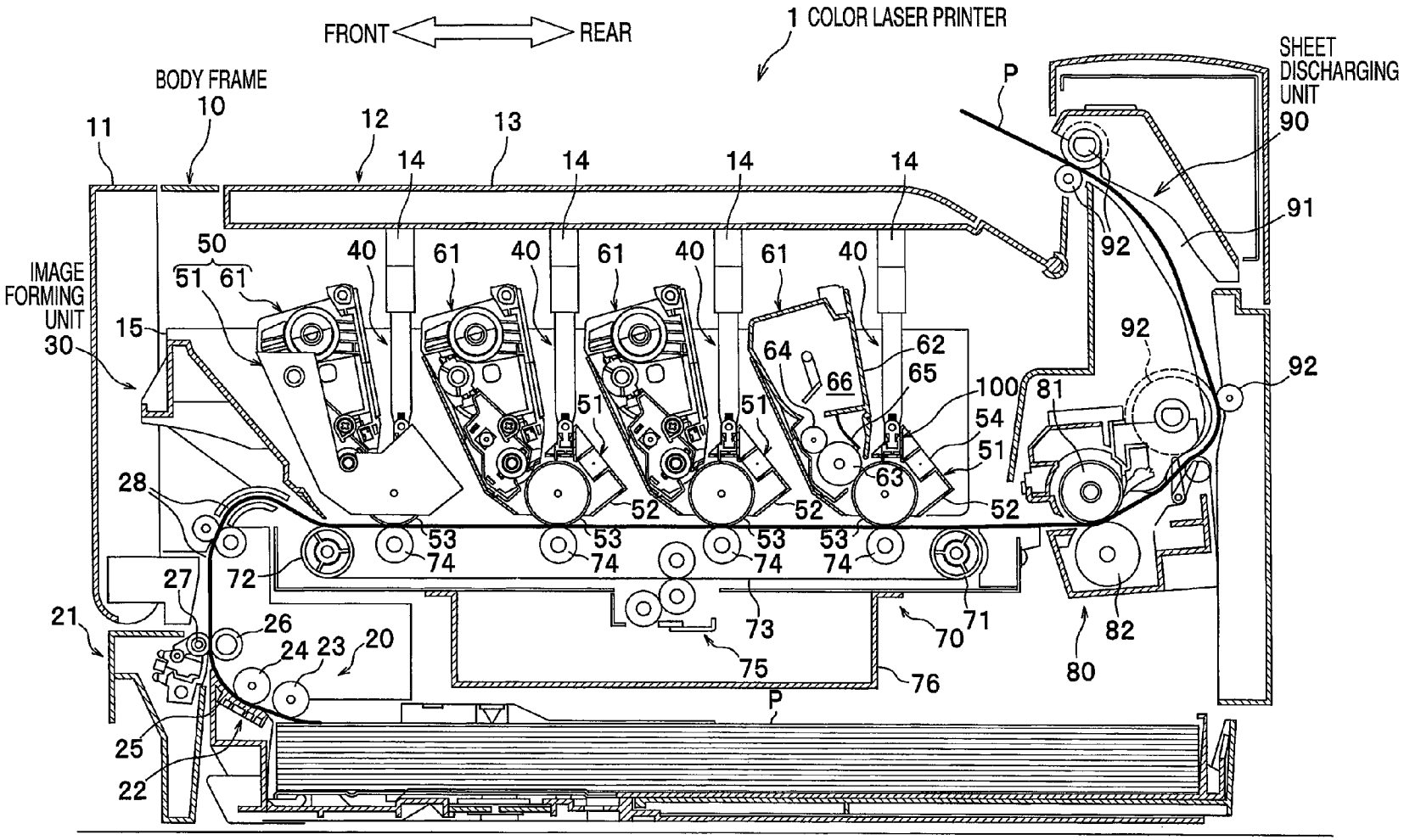
FIG. 1 is a sectional view showing a printer according to an exemplary embodiment of the present invention.

Hereinafter, exemplary embodiments of the present invention will be described in detail with reference to the accompanying drawing. In the drawings, FIG. 1 is a sectional view illustrating an configuration of a color laser printer as an example of an image forming apparatus and FIG. 2 is a sectional view illustrating the color laser printer where an LED unit is located at a retreating position.

In the following description, directions are based on a user in use of the color laser printer. That is, the left side in FIG. 1 is referred to as "front", the right side is referred to as "rear", the inside is referred to as "left", and the front side is referred to as "right". The vertical direction in the direction facing the drawing sheet is referred to as "vertical direction".

As shown in FIG. 1, the color laser printer 1 includes a sheet feeding unit 20 feeding a sheet P into a body frame 10, an image forming unit 30 forming an image on the fed sheet P, and a sheet discharging unit 90 discharging the sheet P on which an image is formed.

Figure 2:
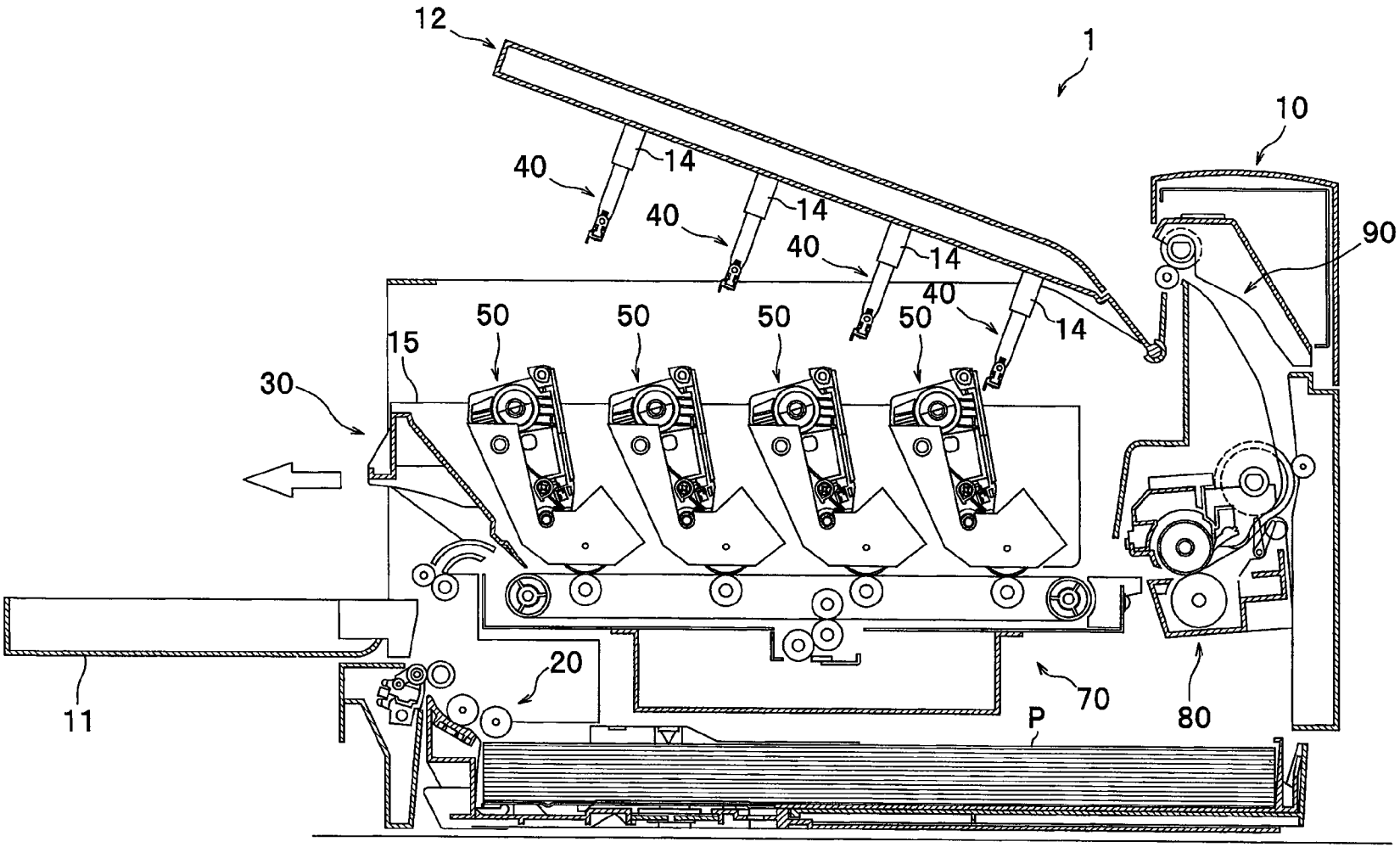
FIG. 2 is a sectional view showing the printer where an LED unit is located at a retreating position.

A front cover 11 that can be opened and closed is disposed in the front side of the body frame 10 to be rotatable forward and backward (to the front and rear sides) about a lower portion and an upper cover 12 that can be opened and closed is disposed in the upper portion of the body frame 10 to be rotatable vertically about a hinge portion disposed in the rear side (see FIG. 2). The top surface of the upper cover 12 is provided with a sheet discharging tray 13 on which a sheet P discharged from the body frame 10 is stacked and the bottom surface is provided with plural holding members 14 holding LED units 40 to be described later.

A frame 15 detachably housing process units 50 to be described later is disposed in the body frame 10. As shown in FIG. 2, the frame 15 can be drawn out forward (in the arrow direction) from an opening generated when the upper cover 12 is opened to allow the LED units 40 to retreat upward and then the front cover 11 is opened. Accordingly, in a state where the frame 15 is drawn out, the process units 50 can be replaced.

As shown in FIG. 1, the sheet feeding unit 20 is disposed in the lower portion of the body frame 10 and includes a sheet feeding tray 21 detachably attached to the body frame 10 and a sheet feeding mechanism 22 conveying a sheet P from the sheet feeding tray 21 to the image forming unit 30. The sheet feeding mechanism 22 is disposed in front of the sheet feeding tray 21 and includes a feed roller 23, a separation roller 24, and a separation pad 25.

In the sheet feeding unit 20 having the above-mentioned configuration, sheets P in the sheet feeding tray 21 are separated and conveyed to the upside sheet by sheet, paper dust is removed therefrom in the course of passing between a paper dust removing roller 26 and a pinch roller 27, the direction is switched to the rear side in the course of passing through a conveying path 28, and then the sheets are supplied to the image forming unit 30 (onto a conveying belt 73).

The image forming unit 30 includes four LED units 40 as an example of the exposure member, four process units 50 (drum unit 51 and developing unit 61), a transfer unit 70, and a fixing unit 80.

At an exposure position (see FIG. 1) where an end portion (light-emitting surface 40A, see FIG. 4) is opposed to the corresponding photosensitive drum 53 from the upside, the upper end of each LED unit 40 is fixed to the upper cover 12 of the body frame 10 with the holding member 14 interposed there between and a dust-proof and positioning member 100 to be described later is disposed at the lower end thereof. The LED units 40 are alternately disposed at the exposure position in the order of the process unit 50 (specifically, the developing unit 61) and the LED unit 40 from the front side. As shown in FIG. 2, the LED units 40 can move from the exposure position to the retreated position by opening the upper cover 12. The details of the LED units 40 will be described later.

The process units 50 are arranged in the front-rear direction between the upper cover 12 and the sheet feeding unit 20 and each include a drum unit 51 and a developing unit 61 detachably attached to the drum unit 51. The process units 50 are different from each other in colors of toner (developer) contained in toner containing chambers 66 of the developing units 61 and are equal to each other in the other configuration.

The drum unit 51 includes a drum frame 52 as an example of the frame, a photosensitive drum 53 as an example of the photosensitive member rotatably supported by the drum frame 52, and a scorotron-type charger 54.

Figure 3:
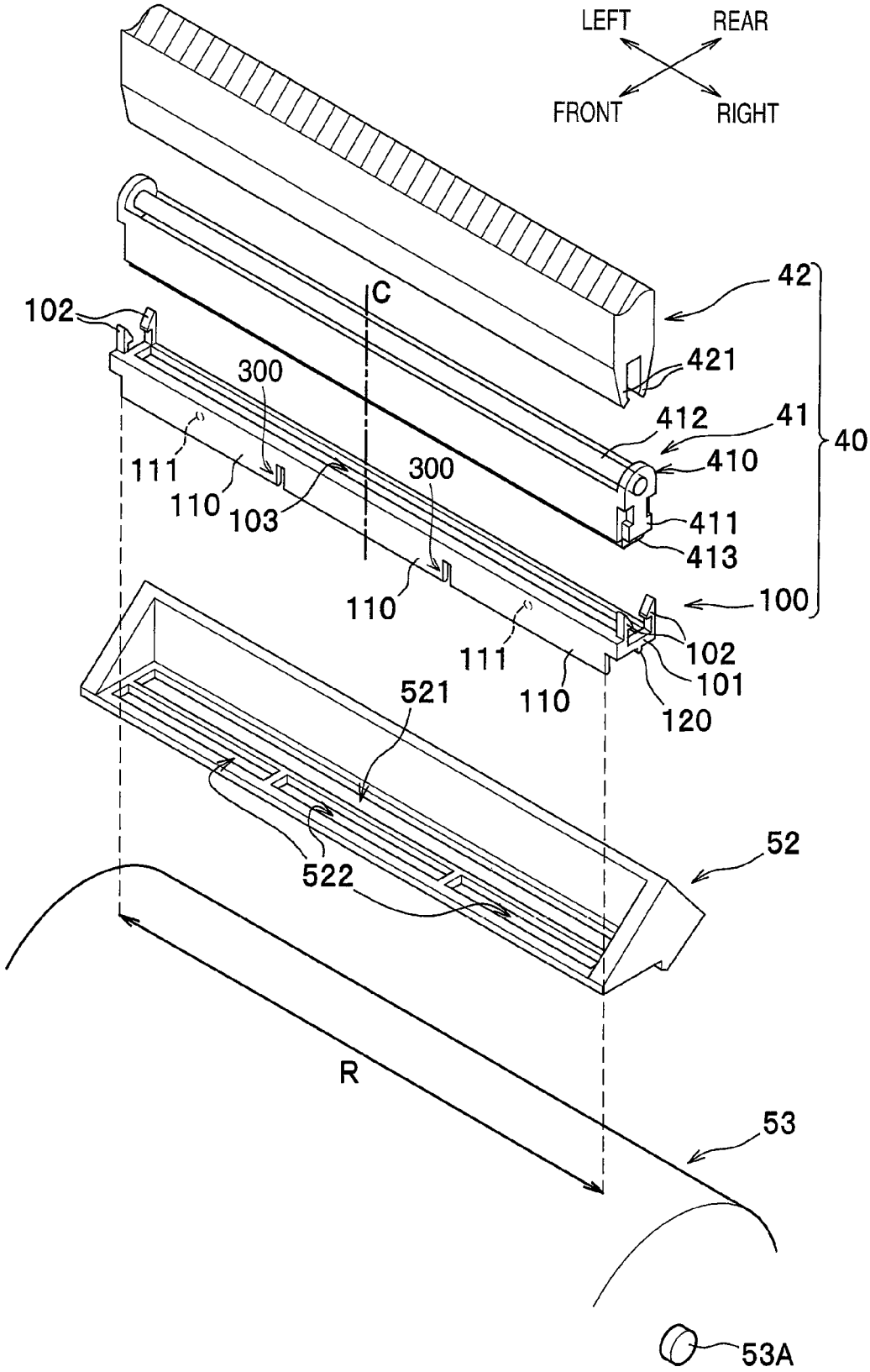
FIG. 3 is a perspective view showing the LED unit, a drum frame, and a photosensitive drum.

In a surface opposed to the photosensitive drum 53 from the upside, the drum frame 52 have an exposure hole 521 for applying LED light emitted from the LED unit 40 to the photosensitive drum 53 and plural through holes 522 into which a dust-proof wall 110 is inserted at the exposure position (see FIG. 3).

The developing unit 61 includes a developing frame 62, a developing roller 63 and a supply roller 64 rotatably supported by the developing frame 62, a thickness regulating blade 65, and a toner containing chamber 66 containing toner.

The transfer unit 70 is disposed between the sheet feeding unit 20 and the process units 50, and includes a driving roller 71, a driven roller 72, a conveying belt 73, a transfer roller 74, and a cleaning unit 75.

The driving roller 71 and the driven roller 72 are separated in the front-rear direction and disposed parallel to each other, and the conveying belt 73 as an endless belt is suspended there between. The outer surface of the conveying belt 73 is in contact with the photosensitive drums 53. Four transfer rollers 74 interposing the conveying belt 73 along with the photosensitive drums 53 are disposed inside the conveying belt 73 to be opposed to the photosensitive drums 53. A transfer bias is applied to the transfer rollers 74 under the electrostatic current control at the time of transfer.

The cleaning unit 75 is disposed below the conveying belt 73 and serves to remove the toner attached to the conveying belt 73 and to drop the removed toner in a toner reservoir 76 disposed below.

The fixing unit 80 is disposed in the rear side of the process units 50 and the transfer unit 70 and includes a heating roller 81 and a pressing roller 82 opposed to the heating roller 81 and pressing the heating roller 81.

In the image forming unit 30 having the above-mentioned configuration, the surfaces of the photosensitive drums 53 are first charged uniform by the scorotron-type charger 54 and then are exposed by the LED light emitted from the LED units 40. Accordingly, the potential of the exposed portions is lowered to form an electrostatic latent image based on image data on the photosensitive drum 53.

The toner in the toner containing chamber 66 is supplied to the developing roller 63 with the rotation of the supply roller 64, enters a space between the developing roller 63 and the thickness regulating blade 65 with the rotation of the developing roller 63, and is held on the developing roller 63 as a thin layer with a constant thickness.

The toner held on the developing roller 63 is supplied to the electrostatic latent image formed on the photosensitive drum 53 when the developing roller 63 comes in contact with the photosensitive drum 53. Accordingly, the toner is selectively held on the photosensitive drum 53 to visualize the electrostatic latent image, thereby forming toner images by an inversion phenomenon.

Then, the sheet P fed to the conveying belt 73 passes between the photosensitive drums 53 and the transfer rollers 74 disposed inside the conveying belt 73, whereby the toner image formed on the photosensitive drums 53 are transferred onto the sheet P.

Then, the sheet P passes between the heating roller 81 and the pressing roller 82, whereby the toner images transferred onto the sheet P are thermally fixed.

The sheet discharging unit 90 includes a discharge-side conveying path 91 formed to extend upward from the exit of the fixing unit 80 and to be inverted to the front side and plural pairs of conveying rollers 92 conveying the sheet P. The sheet P (sheet P having an image formed thereon) onto which the toner images have been transferred and thermally fixed is conveyed along the discharge-side conveying path 91 by the conveying rollers 92, is discharged from the body frame 10, and is stacked on the sheet discharging tray 13.

The exemplary embodiment will be described in more detail hereinafter. In the drawings, FIG. 3 is a perspective view illustrating the LED unit, the drum frame, and the photosensitive drum. FIG. 4A is a side view illustrating relations between the LED unit, the drum frame, and the photosensitive drum at the exposure position and FIG. 4B is a sectional view thereof.

As shown in FIG. 3, the exemplary embodiment include the dust-proof and positioning member 100 of the LED unit 40 and an exposure hole 521 and through holes 522 formed in the drum frame 52. First, the detailed structure of the LED unit 40 is described.

The LED unit 40 includes an LED head 41 emitting LED light, an arm member 42 pivotably supporting the LED head 41, and a dust-proof and positioning member 100.

Figure 4B:
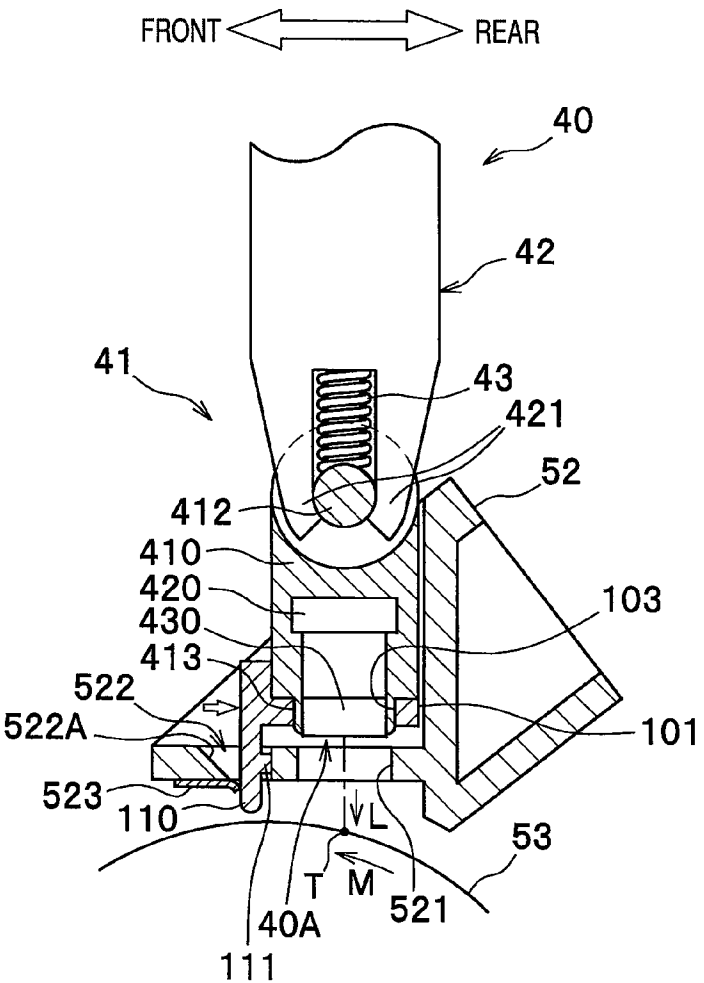
Figure 4A:
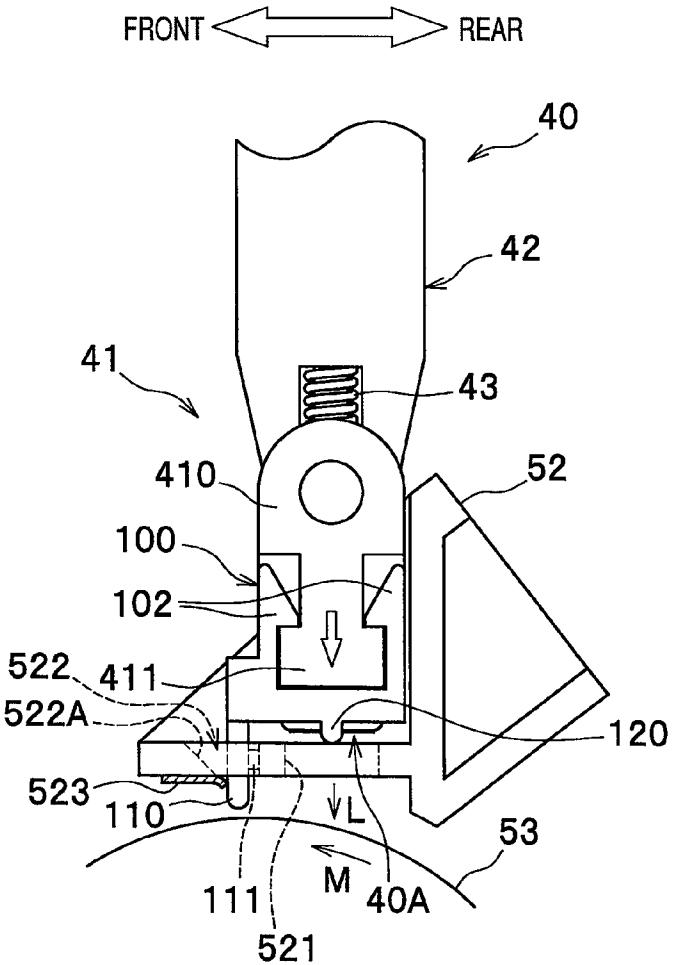

As shown in FIG. 4B, the LED heads 41 are arranged laterally in an LED head body 410 and each include LEDs (Light Emitting Diodes) 420 as an example of the plural light-emitting elements opposed to the photosensitive drum 53 and a lens 430.

A light-emitting surface 40A is formed on the lower end surface of the lens 430 at the exposure position. The LED light emitted from the LEDs 420 are emitted from the light-emitting surface 40A through the lens 430 and is applied to the photosensitive drum 53 through the exposure hole 521 of the drum frame 52.

As shown in FIG. 3, in the LED head body 410, engaging portions 411 (of which one is not shown) are disposed on both ends in a direction (in the rotation shaft direction of the photosensitive drum 53 in this exemplary embodiment) substantially perpendicular to a movement direction (the rotation direction M of the photosensitive drum 53) of the circumferential surface of the photosensitive drum 53 at the opposed position T (see FIG. 4B) of the photosensitive drum 53 and an emission direction L (in the optical axis direction of the LED light) of the LED light from the light-emitting surface 40A. A cylindrical arm attachment portion 412 is disposed in the upper portion of the LED head body 410 and an inserting portion 413 is disposed in the lower portion.

The upper end of the arm member 42 is fixed to the upper cover 12 of the body frame 10 with the holding member 14 interposed there between and the LED head 41 is attached to the lower end. More specifically, the head attachment portion 421 disposed at the lower end of the arm member 42 engages with the arm attachment portion 412 of the LED head 41 so as to be rotatable about the arm attachment portion 412 of the LED head 41 (see FIG. 4B). In this way, since the LED head 41 is rotatably supported by the arm member 42, the end (lower end) of the LED head 41 is pivotable in the front-rear direction at the exposure position.

The spring 43 is disposed between the arm attachment portion 412 and the bottom surface of the concave portion of the head attachment portion 421. Accordingly, the LED head 41 is movable vertically relative to the arm member 42. In this exemplary embodiment, a compression coil spring is employed as the spring 43.

As shown in FIG. 3, the dust-proof and positioning member 100 includes a frame-shaped member body 101 having a rectangular hole 103, locking claws 102 disposed at both lateral sides of the member body 101, plural dust-proof walls 110, and a positioning portion 120 as an example of the positioning member, where theses elements are integrally formed.

Three dust-proof walls 110 are disposed in front of the member body 101 in the rotation shaft direction (lateral direction) of the photosensitive drum 53 of the LED unit 40. The dust-proof wall 110 is symmetric about the center position C in the rotation shaft direction of the photosensitive drum 53 and is disposed in an electrostatic latent image forming area R on the photosensitive drum 53 in the rotation shaft direction of the photosensitive drum 53. Protrusions 111 coming in contact with the rear inner wall of the through hole 522 of the drum frame 52 at the exposure position are disposed inside the three dust-proof wall 110 and in the vicinity of the center of the rear wall of two dust-proof walls 110 disposed on both sides in the rotation shaft direction of the photosensitive drum 53.

It is preferable that the dust-proof walls 110 are made of an insulating material, and an example thereof includes polystyrene and polycarbonate. Accordingly, it is possible to prevent the electric discharge between the photosensitive drum 53 and the dust-proof wall 110 close to each other at the exposure position.

The positioning portions 120 are a protrusion-like portion disposed in the vicinity of both lateral ends (one is not shown) of the lower surface of the member body 101. In this exemplary embodiment, the positioning portions 120 are disposed in the vicinity of both lateral ends of the lower surface of the member body 101, respectively, but plural positioning portions may be disposed.

The dust-proof and positioning member 100 is disposed in the light-emitting surface 40A of the LED head 41 in this exemplary embodiment. The attachment of the dust-proof and positioning member 100 and the LED head 41 will be described in detail now. First, the insertion portion 413 of the LED head 41 is inserted into the hole 103 of the dust-proof and positioning member 100. At this time, in a state where the locking claws 102 is widened forward and backward (in the front-rear direction) by the locking portions 411 of the LED head 41 and the insertion portions 413 are completely inserted into the hole 103, the locking claws 102 are restored to the original shape and thus the locking claws 102 lock the locking portions 411. Accordingly, as shown in FIG. 4A, the dust-proof and positioning member 100 is fixed to the light-emitting surface 40A side of the LED head 41.

As shown in FIG. 4, the exposure hole 521 and the through holes 522 are vertically formed through the surface opposed to the photosensitive drum 53 of the drum frame 52 from the upside. A tapered surface 522A widened from the downside to the upside is disposed in the front inner wall of each through holes 522 so as to avoid the locus of the end of the dust-proof wall 110 when the LED unit 40 moves between the exposure position and the retreated position.

As shown in FIG. 4, an urging member 523 is attached to the lower surface of the surface opposed to the photosensitive drum 53 of the drum frame 52 from the upside. The urging member 523 is a plate-like flexible member and is configured to protrude from the lower end of the tapered surface 522A to the rear side. The portion of the urging member 523 protruding from the lower end of the tapered surface 522A to the rear side comes in contact with the end of the dust-proof wall 110 when the dust-proof wall 100 is inserted into the through hole 522, and is thus elastically deformed downward.

Operations of the dust-proof and positioning member 100 of the LED unit 40 will be described now.

As shown in FIG. 4, when the LED unit 40 having the dust-proof and positioning member 100 is made to move from the retreated position (see FIG. 2) to the exposure position, the dust-proof wall 110 is inserted into the through hole 522 disposed in the drum frame 52, the protrusion 111 comes in contact with the rear inner wall of the through hole 522, and the positioning portions 120 come in contact with the drum frames 52 on both lateral sides of the exposure hole 521.

At this time, since the spring 43 disposed between the LED head 41 and the arm member 42 is slightly compressed, a downward (the arrow direction in FIG. 4A) urging force is applied to the LED head 41, and the positioning portions 120 reliably come in contact with the drum frames 52. Since the ends of the dust-proof walls 110 come in contact with the portion of the urging member 523 protruding from the lower end of the tapered surface 522A to the rear side, an urging force toward the rear inner walls of the through holes 522 is applied to the protrusions 111 through the dust-proof walls 110 and the protrusions 111 reliably come in contact with the rear inner walls of the through holes 522.

Since the positioning portions 120 come in contact with the drum frames 52, the vertical position of the LED unit 40 to which the dust-proof and positioning member 100 is attached can be positioned with high precision and the position in the height direction (in the vertical direction) of the dust-proof walls 110 formed integrally with the positioning portions 120 can be positioned relative to the photosensitive drum 53 with high precision. Since the protrusions 111 come in contact with the rear inner walls of the through holes 522 of the drum frames 52, the position of the dust-proof walls 110 longitudinal in the lateral direction can be determined parallel to the rotation shaft 53A (see FIG. 3) of the photosensitive drum 53.

The ends of the dust-proof walls 110 protrude more toward the photosensitive drum 53 than the light-emitting surface 40A and have a size sufficiently close to the photosensitive drum 53. The dust-proof walls 110 are disposed on the front side of the member body 101, that is, more downstream (closer to the developing unit 61: see FIG. 1) in the rotation direction M of the photosensitive drum 53 than the opposed position T (see FIG. 4B) on the photosensitive drum 53 opposed to the LED unit 40. Accordingly, it is possible to effectively prevent the toner floating from the developing unit 61 from being attached to the light-emitting surface 40A.

Since the positioning portions 120 formed integrally come in contact with the drum frames 52 in the vicinity of the dust-proof walls 110, the dust-proof walls 110 are positioned relative to the photosensitive drum 53 with high precision. Since the dust-proof walls 110 are positioned relative to the photosensitive drum 53 with high precision, it is possible to prevent the ends of the dust-proof walls 110 from coming in contact with the photosensitive drum 53 to damage the surface thereof even when the ends of the dust-proof walls 110 is made to approach the photosensitive drum 53.

In the color laser printer 1 having the above-mentioned configuration, since the dust-proof walls 110 and the positioning portions 120 are formed integrally and thus the dust-proof walls 110 also serve as the positioning member, it is possible to position the dust-proof walls 110 relative to the photosensitive drum 53 with high precision. Accordingly, since the dust-proof walls 110 can be made to sufficiently approach the photosensitive drum 53, the attachment of the toner to the light-emitting surface 40A, that is, the contamination of the light-emitting surface 40A due to the toner, can be satisfactorily suppressed, thereby suppressing the deterioration in quality of image.

Although the exemplary embodiment of the present invention has been described, the present invention is not limited to this exemplary embodiment. The specific configurations thereof can be properly modified without departing from the gist of the present invention.

Although the drum frames 52 supporting the photosensitive drum 53 have been employed as an example of the frame in the above-mentioned exemplary embodiment, the present invention is not limited to the configuration. For example, a frame in which the drum frames 52 and the developing frame 62 are integrally formed, that is, a frame supporting both the photosensitive drum 53 and the developing roller 63, may be employed.

Although it has been described in the above-mentioned exemplary embodiment that the LED head 41 and the dust-proof and positioning member 100 are formed independently of each other and the dust-proof and positioning member 100 are attached to the light-emitting surface 40A side of the LED head 41, the present invention is not limited to the configuration. For example, the LED head 41 and the dust-proof and positioning member 100 may be formed integrally. In this case, it is possible to further improve the positioning precision of the dust-proof walls 110 relative to the photosensitive drum 53.

Although it has been described in the above-mentioned exemplary embodiment that three dust-proof walls 110 are disposed in the dust-proof and positioning member 100, the present invention is not limited to three, but two or four or more dust-proof walls may be disposed.

A single wall continuous in the rotation shaft direction (lateral direction) of the photosensitive drum 53 maybe formed as the dust-proof walls. In this case, since the gaps between the dust-proof walls due to the plural dust-proof walls are removed, it is possible to further reliably prevent the toner floating from the developing unit from being attached to the light-emitting surface.

Although it has been described in the above-mentioned exemplary embodiment that the dust-proof walls 110 are disposed in the range of the electrostatic latent image forming area R on the photosensitive drum 53, the present invention is not limited to the configuration, but the dust-proof walls 110 may be disposed over the electrostatic latent image forming area R.

Although it has been described in the above-mentioned exemplary embodiment that the dust-proof walls 110 are disposed only in front of the light-emitting surface 40A, the present invention is not limited. For example, the dust-proof walls 110 may be disposed on both the front side and the rear side (on the more upstream side in the rotation direction M of the photosensitive drum 53 than the opposed position T between the photosensitive drum 53 and the LED unit 40). In this case, it is possible to effectively protect the light-emitting surface 40A (lens 430) at the retreated position (see FIG. 2).

Although it has been described in the above-mentioned exemplary embodiment that the protrusions 111 are disposed in the vicinity of the centers of the rear inner wall surfaces of two dust-proof walls 110 one by one, the present invention is not limited to the configuration. For example, the protrusions may be disposed in the vicinity of the centers of the rear inner wall surfaces of three dust-proof walls 110 one by one, or plural protrusions 111 may be disposed in each dust-proof wall 110. Since the dust-proof walls 110 are positioned parallel to the rotation shaft of the photosensitive drum 53, the protrusions 111 are preferably symmetric about the center position C in the rotation shaft direction of the photosensitive drum 53.

Although it has been described in the above-mentioned exemplary embodiment that the ends of the positioning portions 120 (positioning member) are formed in a semi-spherical shape, the present invention is not limited to the configuration, but a circular cylinder shape or a polygonal pillar shape may be employed. The ends of the positioning portions may be formed in a wall shape or a frame shape protruding more than the light-emitting surface 40A in the lower surface of the member body 101 at the exposure position. A notch 300 (concave portion) may be formed in the dust-proof wall from the downside to the upside and the bottom portion of the concave portion coming in contact with the frame (a portion between the through holes 522) at the exposure position may be used as the positioning portion (positioning member).

Figure 5A:
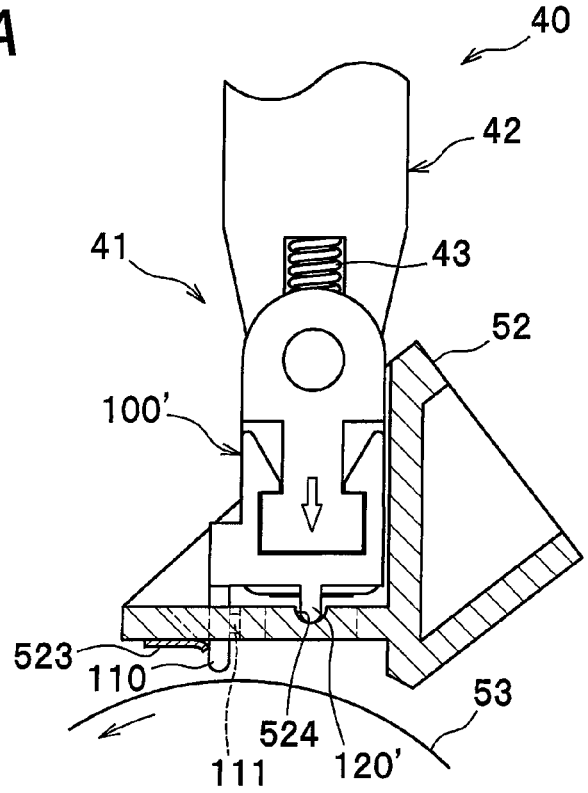
Figure 5B:
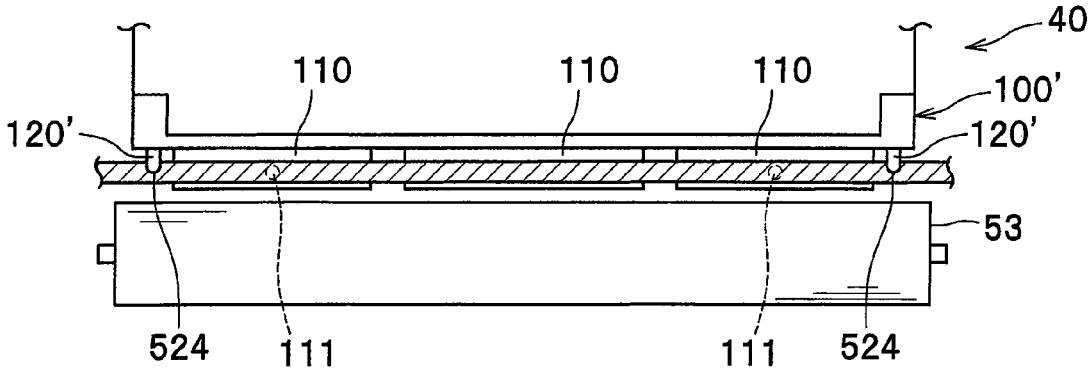
Figure 5C:
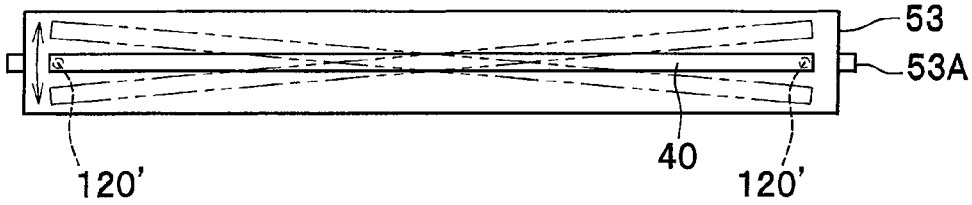

Although it has been described in the above-mentioned exemplary embodiment that the ends of the positioning portions 120 comes in simple contact with the drum frames 52 at the exposure position, the present invention is not limited to the configuration. For example, as shown in the dust-proof and positioning member of 100' FIGS. 5A and 5B, holes 524 of which the bottoms come in contact with the ends of the positioning portions 120' may be formed in the drum frames 52. Accordingly, as shown in FIG. 5C, since the front-rear position of the LED unit 40 can be positioned reliably with high precision, it is possible to prevent the deterioration in quality of image due to a variation in exposure distance resulting from the LED unit 40 oblique about the rotation shaft 53A of the photosensitive drum 53 (see the chained line in FIG. 5C). In this case, the protrusions 111 of the dust-proof walls 110 can be omitted.

Although it has been described in the above-mentioned exemplary embodiment that the LED unit 40 having plural LEDs 420 arranged as the light-emitting elements is employed as an example of the exposure member, the present invention is not limited to the configuration. For example, the light-emitting elements are not limited the LEDs (Light Emitting Diodes), as long as they can be arranged and selectively emit light in accordance with image data, and the light-emitting elements may be EL (Electroluminescence) elements or fluorescent elements. An exposure member in which plural optical shutters (such as liquid crystal elements and PLZT elements) controlling light from a single light-emitting element or plural light-emitting elements (light source) are arranged and the opening and closing time of the optical shutters are selectively controlled in accordance with the image data may be employed.

In the above-mentioned exemplary embodiment, the tapered surface 522A is disposed in the front inner wall of the through hole 522. However, the present invention is not limited to the configuration so long as the LED unit 40 can avoid the locus of the end of the dust-proof walls 110 at the time of moving between the exposure position and the retreating position, and for example, the through hole may be formed to be widened to the front side.

What is claimed is:

1. An image forming apparatus comprising:

a photosensitive member in which an electrostatic latent image is formed on the surface thereof; and an exposure member having a light emitting element, the exposure member exposing the photosensitive member at an exposure position opposed to an opposed position on the photosensitive member to form the electrostatic latent image, the exposure member being movable between the exposure position and a retreated position retreating from the exposure position, wherein the exposure member includes a dust-proof wall protruding more than a light-emitting surface of the exposure member, and a positioning member positioning the exposure member with respect to the photosensitive member at the exposure position, wherein the dust-proof wall and the positioning member are integrally formed, and wherein the dust-proof wall is separate from the photosensitive member when the exposure member is disposed at the exposure position.

2. The image forming apparatus according to claim 1, wherein the dust-proof wall and the positioning member are disposed in the light-emitting surface side of the exposure member.

3. The image forming apparatus according to claim 1, further comprising a frame supporting the photosensitive member and having a through hole into which the dust-proof wall is inserted at the exposure position, wherein the dust-proof wall includes a protrusion coming in contact with one of inner walls of the through hole opposed to each other in a movement direction of the photosensitive member at the opposed position on the photosensitive member at the exposure position.

4. The image forming apparatus according to claim 1, wherein the dust-proof wall is made of an insulating material.

5. The image forming apparatus according to claim 1, wherein the dust-proof wall is symmetric about the center position in a direction perpendicular to the movement direction of the photosensitive member at the opposed position on the photosensitive member and a light emitting direction from the light-emitting surface.

6. The image forming apparatus according to claim 1, wherein the dust-proof wall is disposed in a range corresponding to an area on the photosensitive member in which the electrostatic latent image is formed.

7. The image forming apparatus according to claim 1, wherein the dust-proof wall is disposed more downstream in the movement direction of the photosensitive member at the opposed position on the photosensitive member than the opposed position on the photosensitive member at the exposure position.

8. The image forming apparatus according to claim 1, wherein the dust-proof wall is disposed in a direction perpendicular to a movement direction of the photosensitive member at the opposed position on the photosensitive member and a light-emitting direction from the light-emitting surface.

9. An image forming apparatus comprising:

a photosensitive member;

an exposure member having a light emitting element, a dust-proof wall protruding more than a light-emitting surface of the exposure member and a positioning member positioning the exposure member with respect to the photosensitive member at an exposure position; and a frame supporting the photosensitive member and having a through hole into which the dust-proof wall is inserted at the exposure position;

wherein the dust-proof wall and the positioning member are integrally formed,wherein the dust-proof wall and the positioning member are disposed in the light-emitting surface side of the exposure member, and wherein when the exposure member is positioned at the exposure position, the positioning member contacts on the frame.

10. The image forming apparatus according to claim 9, wherein the dust-proof wall includes a protrusion, and wherein when the exposure member is positioned at the exposure position, the protrusion contacts with an inner wall of the through hole.

11. The image forming apparatus according to claim 9, wherein the dust-proof wall is disposed substantially in parallel to a longitudinal direction of the photosensitive member.

12. The image forming apparatus according to claim 9, wherein the dust-proof wall includes a concave portion that is formed from a downside to an upside, and wherein when the exposure member is positioned at the exposure position, a bottom portion of the concave portion contacts on the frame.

13. The image forming apparatus according to claim 9, wherein the frame includes a hole, and wherein when the exposure member is positioned at the exposure position, the positioning member is inserted in the hole.

* * * * *